US012774830B2

(12) United States Patent
Tokeshi et al.

(10) Patent No.: US 12,774,830 B2
(45) Date of Patent: Oct. 27, 2026

(54) COOLING FLUID CIRCUIT SYSTEM FOR COOLING A RACK FOR ELECTRONIC DEVICES

(71) Applicant: NIDEC CORPORATION, Kyoto (JP)

(72) Inventors: Toshihiko Tokeshi, Kyoto (JP); Takehito Tamaoka, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 110 days.

(21) Appl. No.: 18/757,741

(22) Filed: Jun. 28, 2024

(65) Prior Publication Data

US 2025/0003648 A1 Jan. 2, 2025

(30) Foreign Application Priority Data

Jun. 30, 2023 (JP) ..... 2023-108080

(51) Int. Cl.
*F25B 25/00* (2006.01)
*F25B 49/02* (2006.01)

(52) U.S. Cl.
CPC ..... *F25B 25/005* (2013.01); *F25B 49/02* (2013.01); *F25B 2400/05* (2013.01)

(58) Field of Classification Search
CPC .... F25B 49/02; F25B 2400/05; F25B 25/005; H05K 7/20254; H05K 7/20409; H05K 7/20772; H05K 7/20554–20572
See application file for complete search history.

(56) References Cited

U.S. PATENT DOCUMENTS 6,819,563 B1 * 11/2004 Chu ..... H05K 7/20736 165/104.33
9,043,035 B2 * 5/2015 Chainer ..... G06F 1/3206 700/282
9,313,930 B2 * 4/2016 Goth ..... F28F 27/02
2007/0201210 A1 * 8/2007 Chow ..... H05K 7/20781 361/695
2008/0259566 A1 10/2008 Fried
2024/0357772 A1 * 10/2024 Jing ..... H05K 7/20254

FOREIGN PATENT DOCUMENTS

CN 101779178 A 7/2010
CN 114269129 A * 4/2022 ..... H05K 7/20763

OTHER PUBLICATIONS

Official Communication issued in corresponding Chinese Patent Application No. 113124398, mailed on Mar. 27, 2025, 9 pages.

* cited by examiner

*Primary Examiner* — Cassey D Bauer
(74) *Attorney, Agent, or Firm* — Keating & Bennett, LLP

(57) ABSTRACT

A system cools a heat source in a rack, and includes a cold plate that is in thermal contact with the heat source and through which a first refrigerant flows, a radiator that is in contact with air in the rack and through which a second refrigerant different from the first refrigerant flows, and a heat exchanger to exchange heat between the first refrigerant flowing out of the cold plate and the second refrigerant.

14 Claims, 10 Drawing Sheets

COOLING FLUID CIRCUIT SYSTEM FOR COOLING A RACK FOR ELECTRONIC DEVICES

CROSS-REFERENCE TO RELATED APPLICATIONS

The present application claims priority under 35 U.S.C. § 119 to Japanese Patent Application No. 2023-108080, filed on Jun. 30, 2023, the entire contents of which are hereby incorporated herein by reference.

1. Field of the Invention

The present disclosure relates to systems.

2. Background

A rack according to the related art is provided with a system to cool an electronic device as a heat source. The system includes a radiator on the rear door of the rack. A plurality of fans is provided on the exhaust side of the radiator. A plurality of heat pipes are provided on the air inlet side of the radiator. Since the heat distribution is smoothed by the heat pipe, a decrease in cooling capacity due to local heat concentration is suppressed.

This type of system is required to further improve cooling performance (that is, the performance of cooling the heat source).

SUMMARY

One example embodiment of a system to cool a heat source in a rack of the present disclosure includes a cold plate, a radiator, and a heat exchanger. The cold plate is in thermal contact with the heat source. A first refrigerant flows through the cold plate. The radiator is in contact with air in the rack. A second refrigerant different from the first refrigerant flows inside the radiator. A heat exchanger is operable to exchange heat between the first refrigerant flowing out of the cold plate and the second refrigerant.

Another example embodiment of the present disclosure is directed to a system to cool a heat source in a rack. The system includes a cold plate and a radiator. The cold plate is in thermal contact with the heat source. A first refrigerant flows through the cold plate. The radiator is in contact with air in the rack. The first refrigerant flowing out of the cold plate flows inside the radiator.

The above and other elements, features, steps, characteristics and advantages of the present disclosure will become more apparent from the following detailed description of the example embodiments with reference to the attached drawings.

Figure 1:
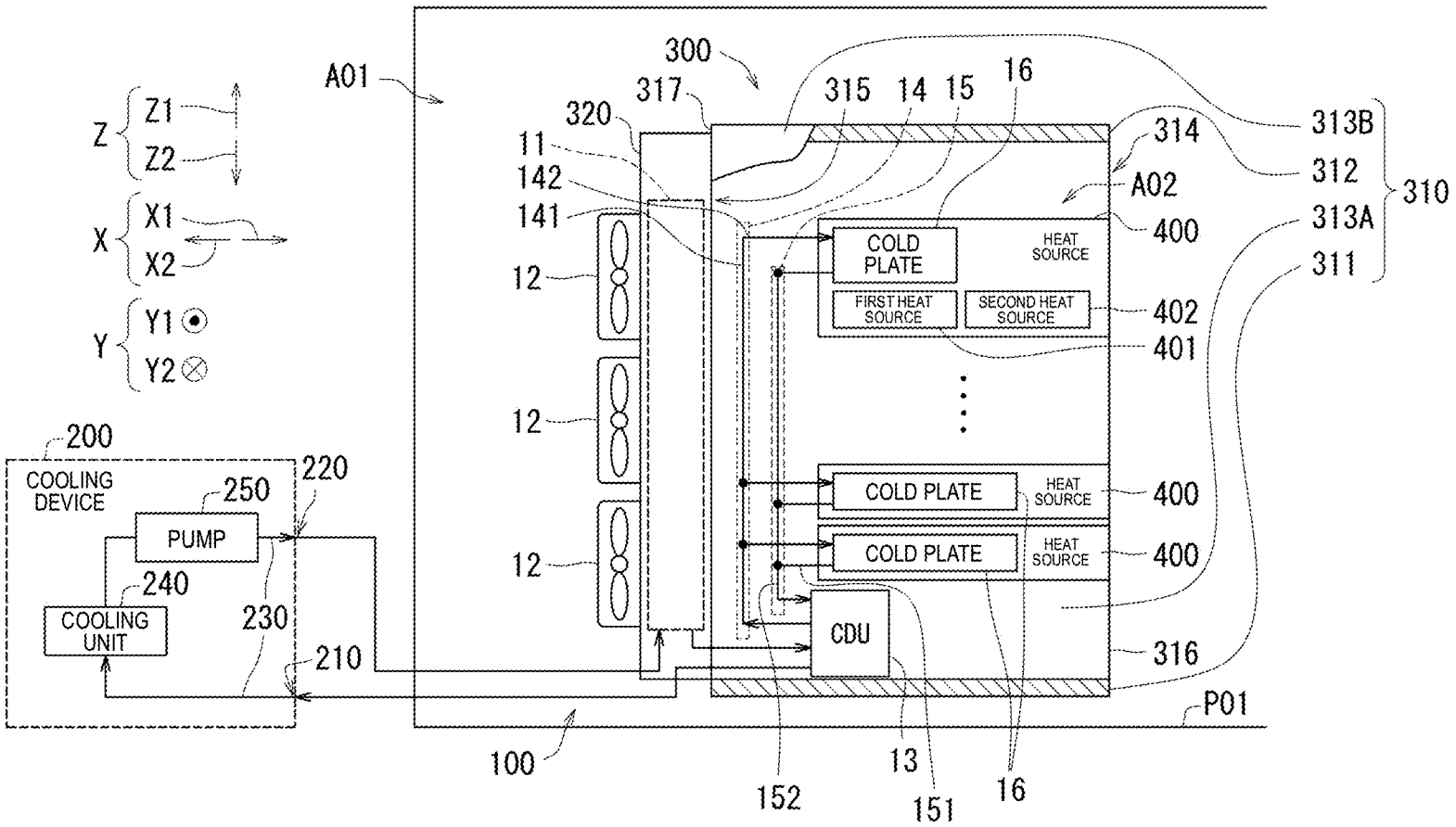
FIG. 1 is a diagram illustrating a system and a cooling device according to a first example embodiment of the present disclosure.

FIG. diagram 3 is a illustrating a detailed configuration of a rear door and a radiator illustrated in FIG. 1.

Figure 4:
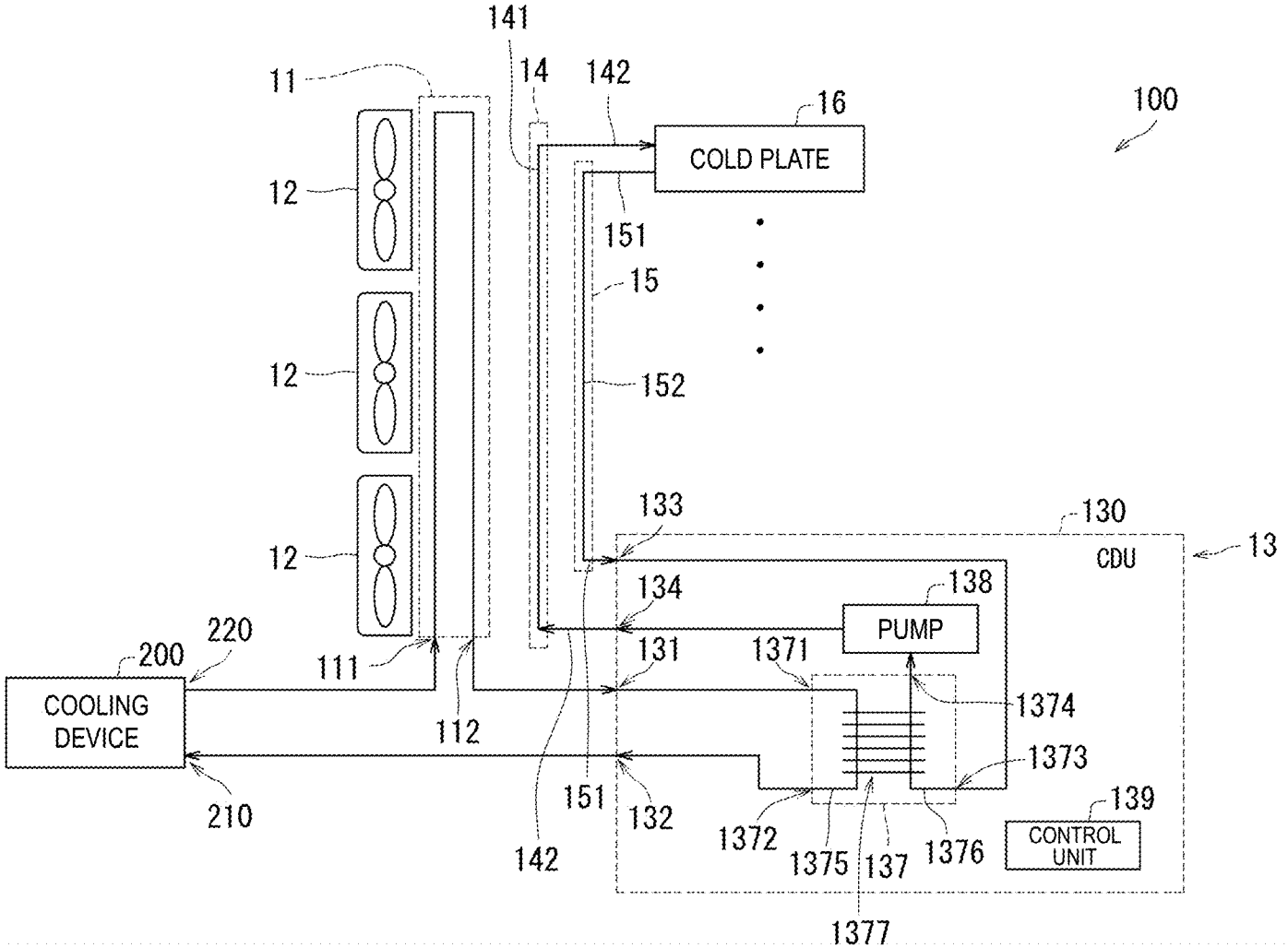

FIG. 4 is a diagram illustrating a detailed configuration of the system illustrated in FIG. 1.

Figure 5:
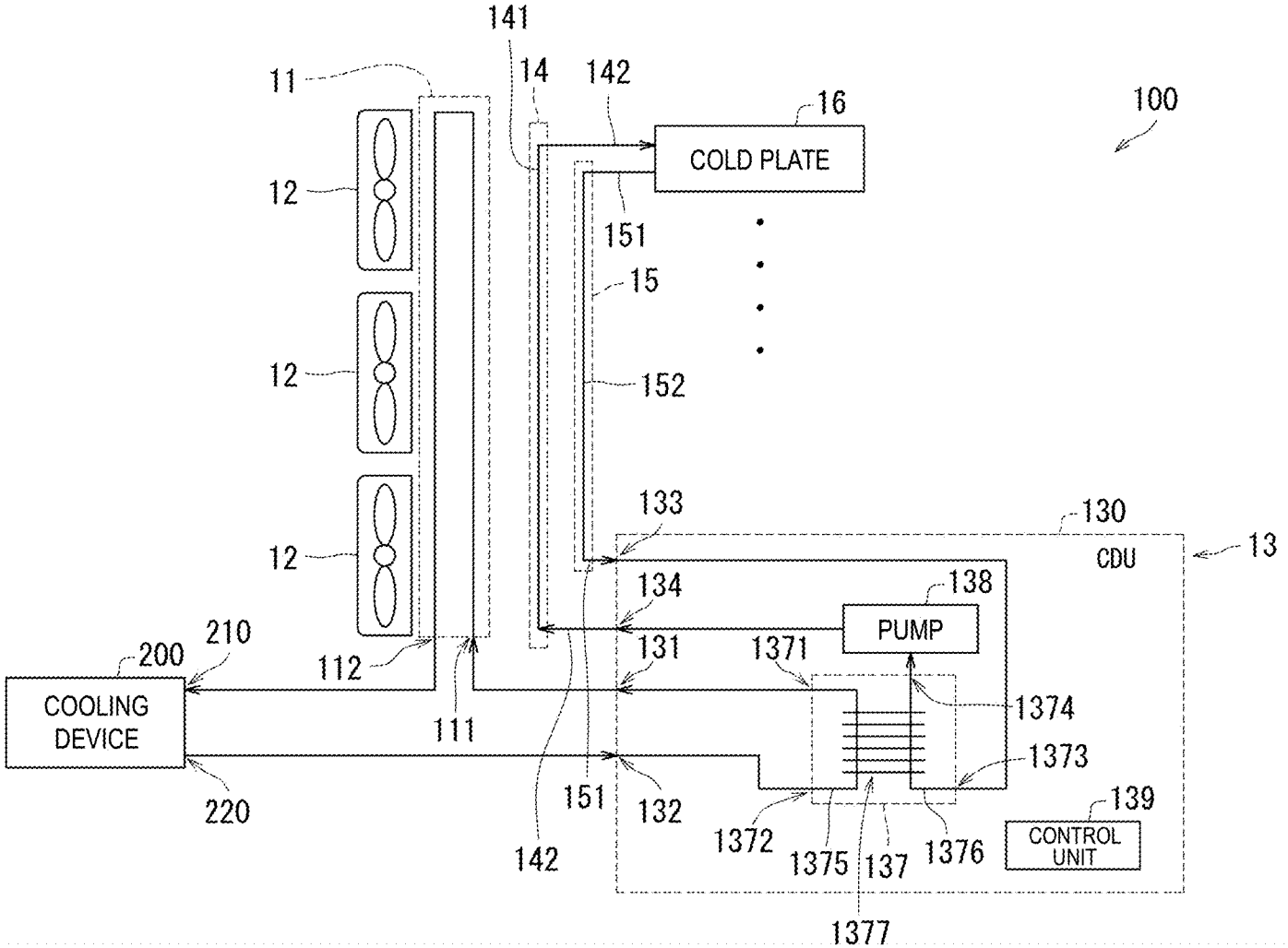

FIG. 5 is a diagram illustrating a detailed configuration of a system according to a modification of the first example embodiment.

Figure 6:
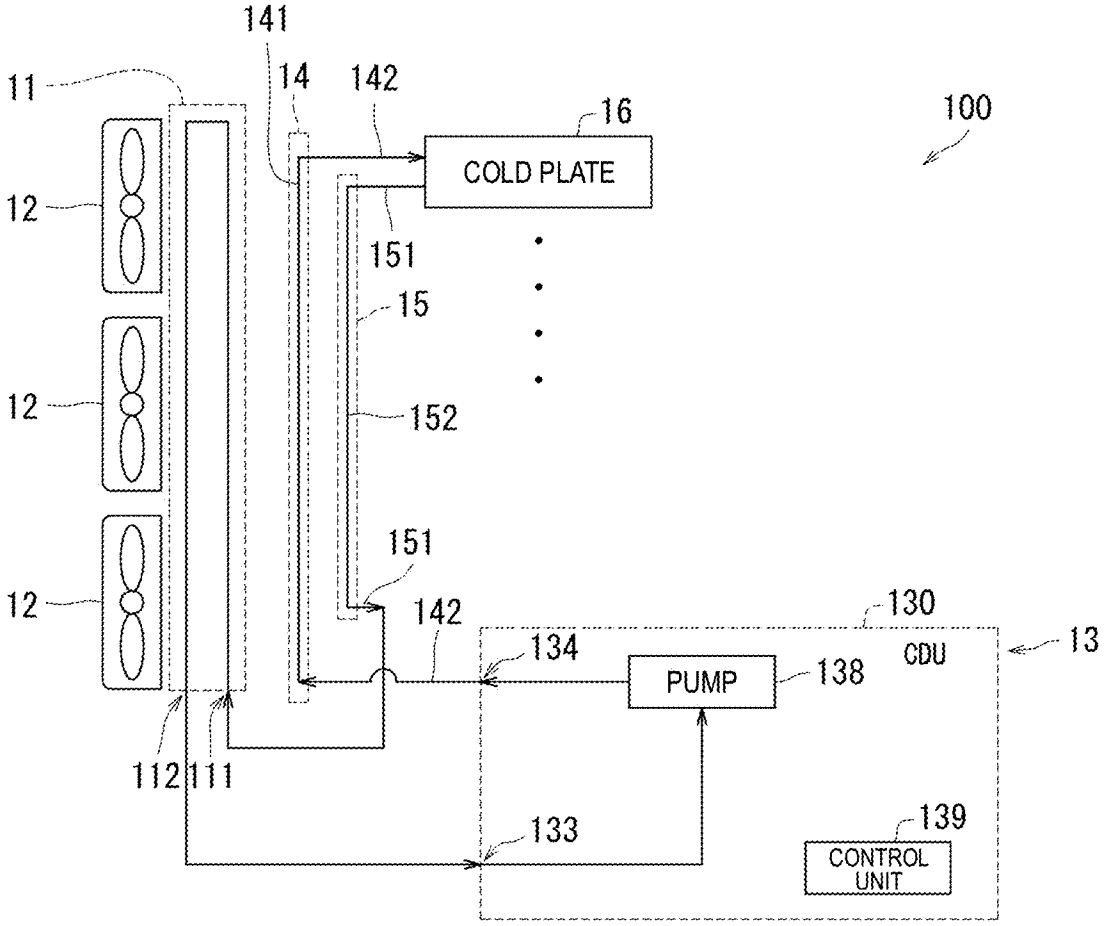

FIG. 6 is a diagram illustrating a detailed configuration of a system according to a second example embodiment of the present disclosure.

Figure 7:
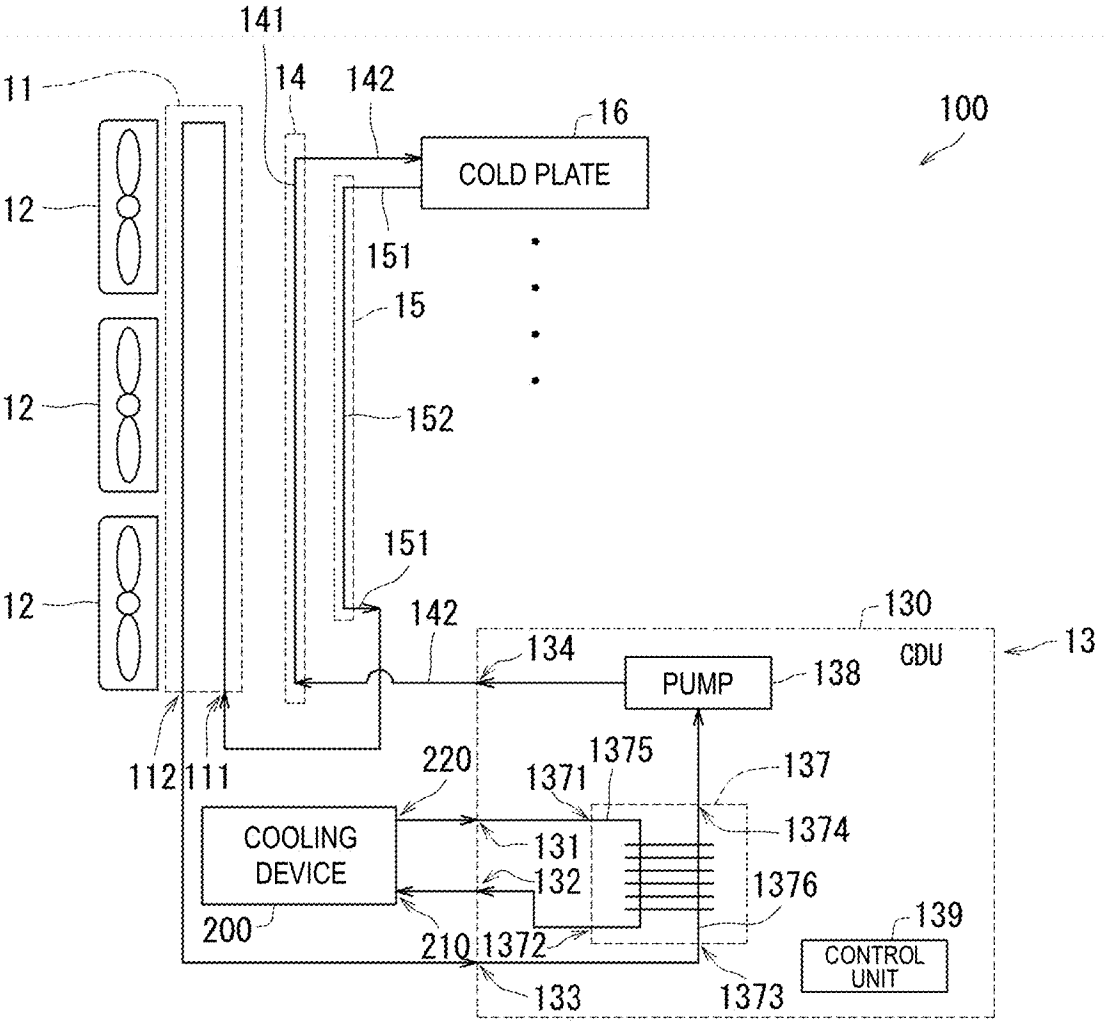

FIG. 7 is a diagram illustrating a detailed configuration of a system according to a modification of the second example embodiment.

Figure 8:
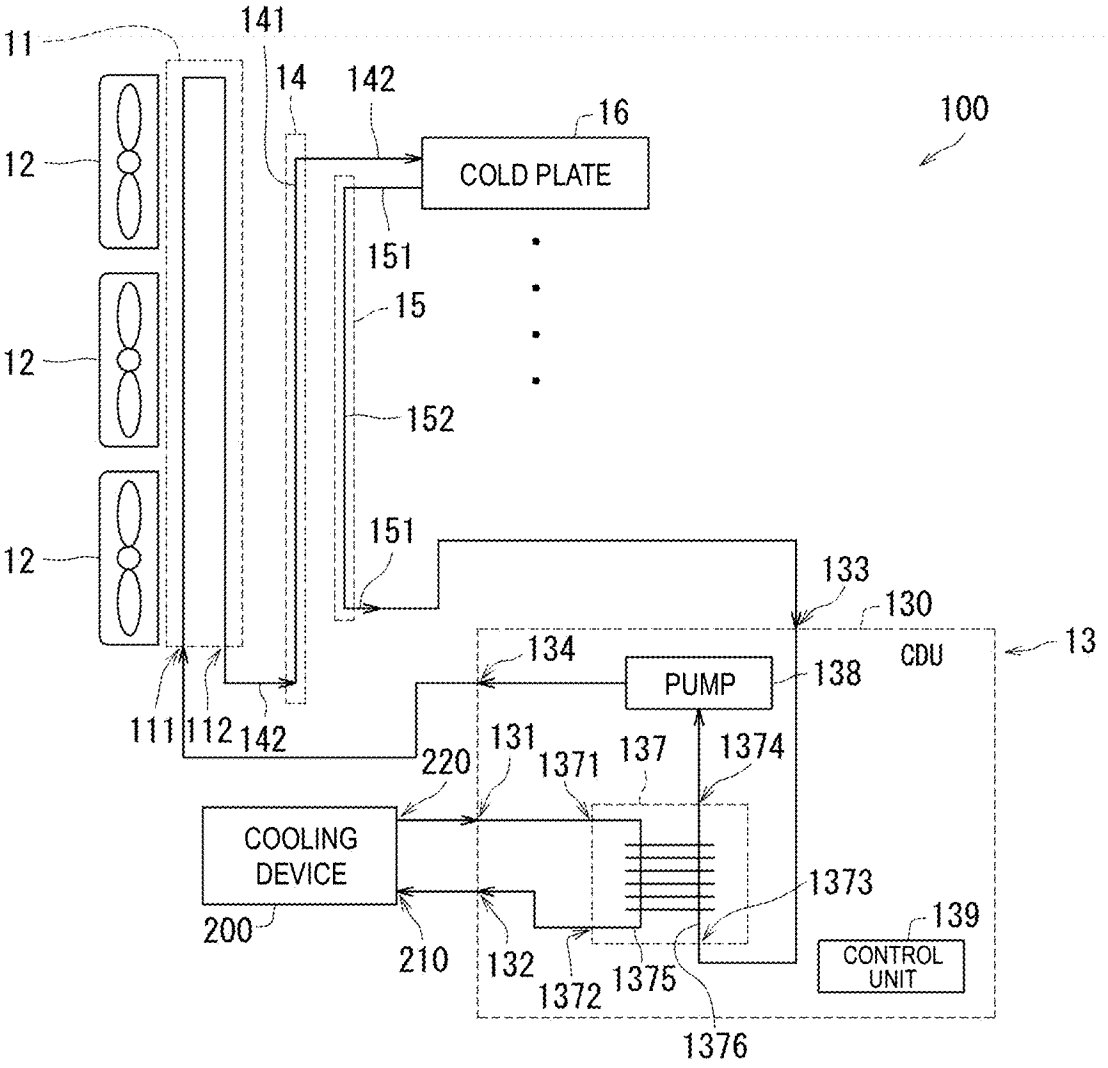

FIG. 8 is a diagram illustrating a detailed configuration of a system according to another modification of the second example embodiment.

Figure 9:
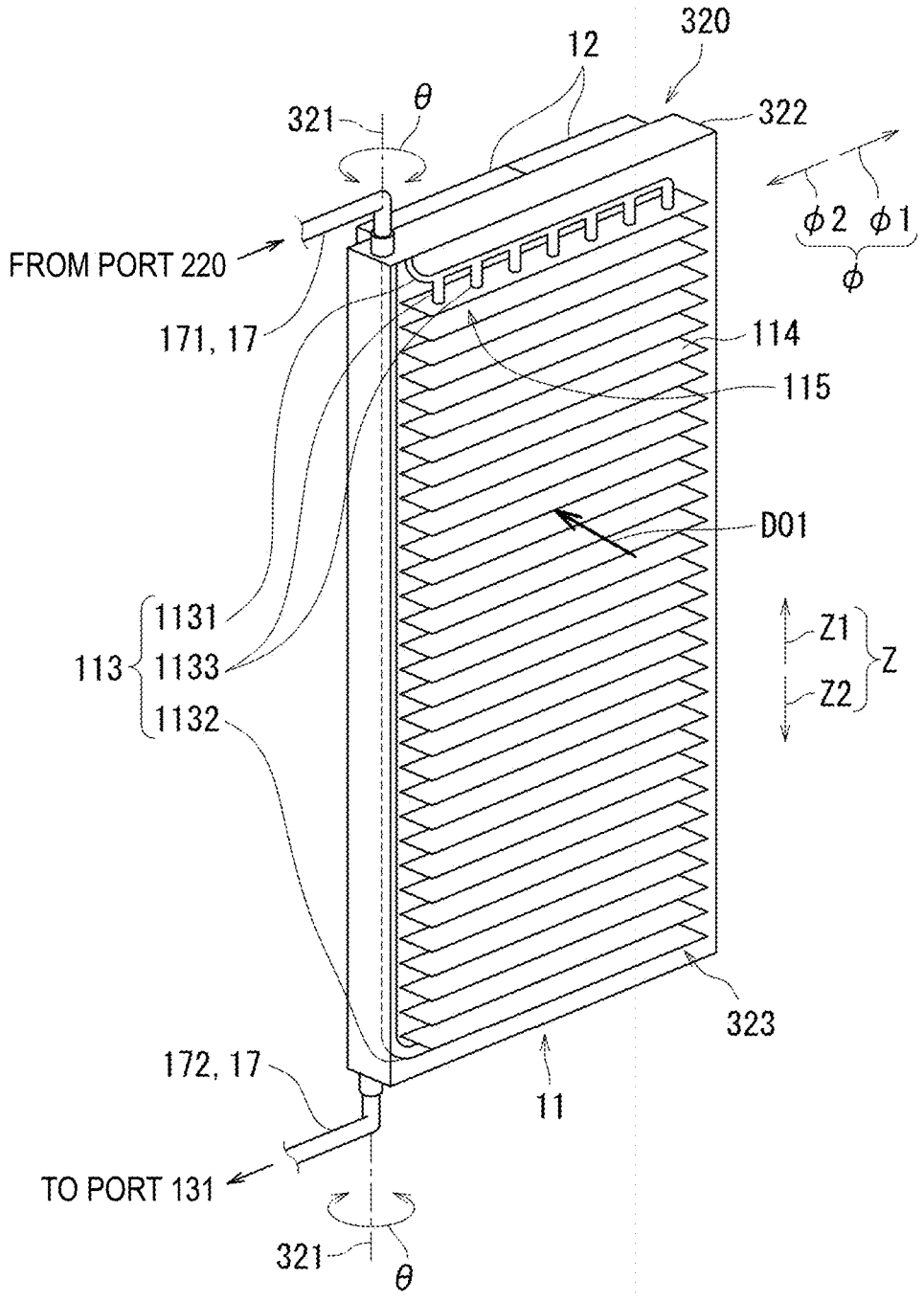

FIG. 9 is a diagram illustrating a first configuration example of a first flow path connecting a radiator and a heat exchanger according to an example embodiment of the present disclosure.

Figure 10:
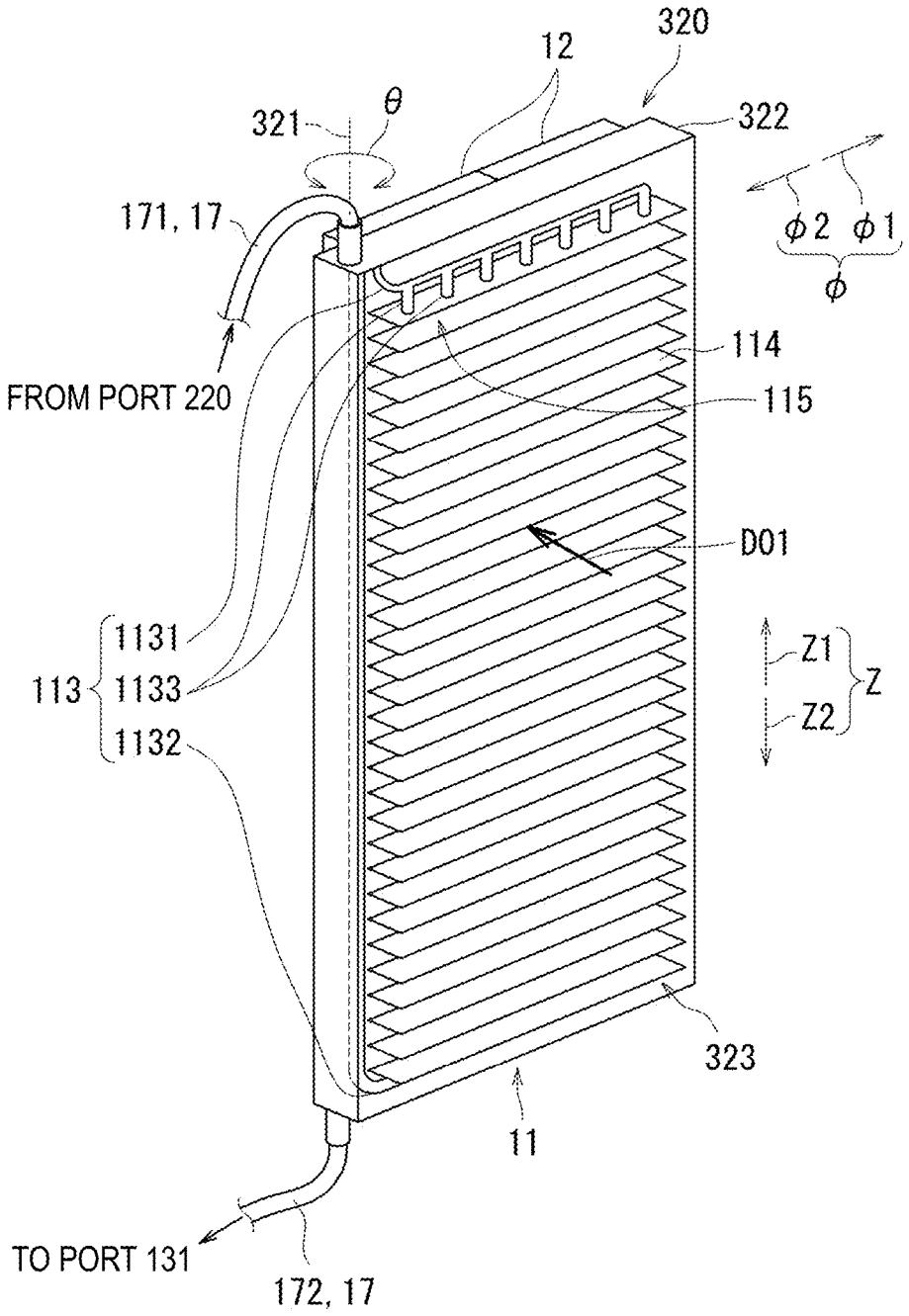

FIG. 10 is a diagram illustrating a second configuration example of the first flow path connecting the radiator and the heat exchanger.

DETAILED DESCRIPTION

Hereinafter, example embodiments of the present disclosure will be described with reference to the drawings. In the drawings, the same or corresponding parts are denoted by the same reference numeral and description thereof will not be repeated.

In each example embodiment, a first direction Z, a second direction X, and a third direction Y intersecting each other are appropriately used for easy understanding. In each example embodiment, the term "intersecting" includes crossing lines, planes, or lines and planes at a right angle to each other, and crossing each other at a non-right angle within a range of tolerance, error, or the like.

The first direction Z, the second direction X, and the third direction Y are defined based on a state (hereinafter, the "use state" is described) in which a rack 300 (see FIG. 1) is installed on an installation surface P01 so as to be usable. Specifically, the first direction Z is a direction intersecting the installation surface P01, and is a vertical direction of the rack 300 in a use state. The second direction X is a direction intersecting a front opening 314 and rear opening 315 formed in the rack 300, and is a front-rear direction of the rack 300. The third direction Y is a direction intersecting each of the first direction Z and the second direction X, and is a left-right direction toward the front opening 314. However, the first direction Z, the second direction X, and the third direction Y are merely defined for convenience of description.

Further, one side and the other side of the first direction Z are referred to as one of one side Z1 of the first direction and the other side 22 of the first direction, respectively. Specifically, one side Z1 of the first direction is an upward direction, and the other side 22 of the first direction is a downward direction. One side and the other side of the second direction X are referred to as one side X1 of the second direction and the other side X2 of the second direction, respectively. One side X1 of the second direction is a forward direction, and the other side X2 of the second direction is a backward direction. One side and the other side of the third direction Y are referred to as one side Y1 of the third direction and the other side Y2 of the third direction, respectively. One side Y1 of the third direction is a left direction, and the other side Y2 of the third direction is a right direction.

Figure 2:
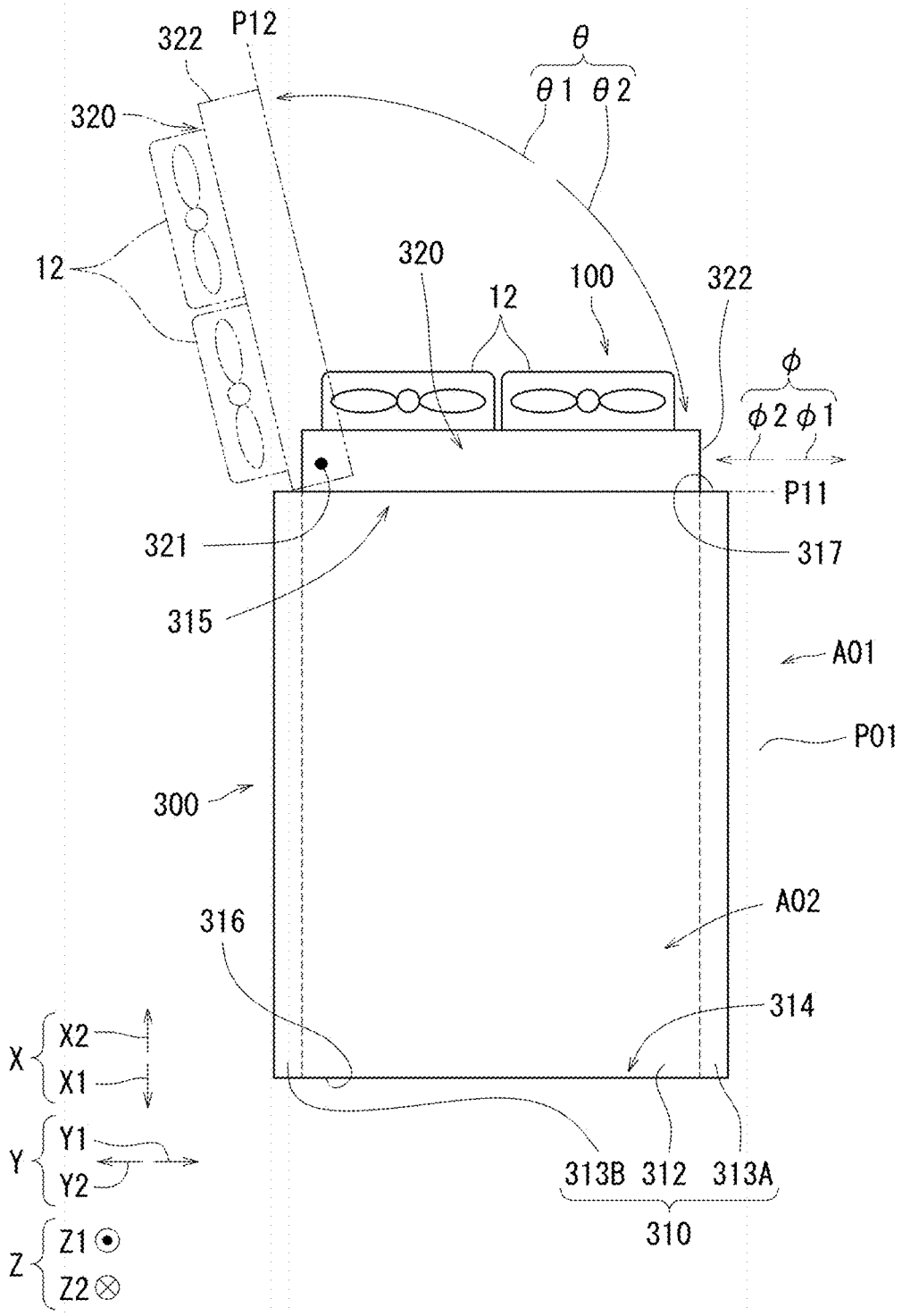
FIG. 2 is a plan view of the system and the rack illustrated in FIG. 1 as viewed from one side in a first direction.

FIG. 1 is a diagram illustrating a system 100 and a cooling device 200 according to a first example embodiment. FIG. 2 is a plan view of the system 100 and the rack 300 illustrated in FIG. 1 as viewed from one side 21 of the first direction. Only a portion of the system 100 is illustrated in FIG. 2 for ease of understanding.

As illustrated in FIGS. 1 and 2, the system 100 is typically installed in a space A01 such as a server room. Specifically, the system 100 is provided in the rack 300. The rack 300 includes at least a chassis 310 and a rear door 320. The chassis 310 defines a space A02. The space A02 accommodates a plurality of heat sources 400 (see FIG. 1). Specifically, the plurality of heat sources 400 are accommodated so as to be arranged in the first direction Z in the space A02. However, the present disclosure is not limited thereto, and the plurality of heat sources 400 may be accommodated so as to be arranged in the third direction Y. The number of heat sources 400 is not limited to a plurality, and may be one.

The heat source 400 is an electronic device such as a rack mounted server or a blade server, and includes at least one of a first heat source 401 and a second heat source 402. In the example embodiment, the heat source 400 includes both the first heat source 401 and the second heat source 402. Each of the first heat source 401 and the second heat source 402 operates by power supply and generates heat. A calorific value of the first heat source 401 is larger than a calorific value of the second heat source 402, and is, for example, a central processing unit (so-called CPU), an electrolytic capacitor, or a power semiconductor module. The second heat source 402 is, for example, a transistor or a diode. The electronic device may also be a projector, a personal computer, or a display.

In the present example embodiment, the chassis 310 has, for example, a bottom wall 311, a top wall 312, and a pair of side walls 313A and 313B. The outer shapes of the bottom wall 311 and the top wall 312 are the same rectangle in plan view from the first direction Z. The bottom wall 311 and the top wall 312 are separated from each other in the first direction Z. The side wall 313A is located between an end portion of the bottom wall 311 in the one side Y1 of the third direction and an end portion of the top wall 312 in the one side Y1 of the third direction, and connects the bottom wall 311 and the top wall 312 to each other. The side wall 313B is located between an end portion of the bottom wall 311 in the other side Y2 of the third direction and an end portion of the top wall 312 in the other side Y2 of the third direction, and connects the bottom wall 311 and the top wall 312 to each other. In FIG. 1, only a part of the side wall 313B is illustrated to illustrate the inside of the space A02.

As illustrated in FIGS. 1 and 2, the chassis 310 has the front opening 314 and the rear opening 315. The front opening 314 and the rear opening 315 are spaces surrounded by a front end 316 and a rear end 317 of the chassis 310, respectively. The space A02 is opened toward the one side X1 of the second direction and the other side X2 of the second direction through the front opening 314 and the rear opening 315. The rear opening 315 is an example of the "opening" of the present disclosure.

The rear door 320 is provided with a radiator 11. The rear door 320 rotates about a rotation axis 321 in the circumferential direction θ of the rotation axis 321 (see FIG. 2). As a result, the rear door 320 opens and closes the rear opening 315. In the example embodiment, the rotation axis 321 extends along the first direction Z. However, the present disclosure is not limited thereto, and the rotation axis 321 may extend along the second direction X. Specifically, the rear door 320 is attached to or near the rear end 317 such that the rear door 320 is rotatable in the circumferential direction θ between a closed position P11 (see FIG. 2) and an open position P12.

In FIG. 2, the rear door 320 in the closed position P11 is indicated by a solid line. On the other hand, the rear door 320 at the open position P12 is indicated by a broken line. At the closed position P11, a distal end 322 of the rear door 320 abuts on the rear end 317. The distal end 322 is a distal end of the rear door 320 in a centrifugal direction φ1 from the rotation axis 321 to the rotation axis 321. The centrifugal direction φ1 is a direction away from the rotation axis 321 in a radial direction φ of the rotation axis 321. A centripetal direction φ2 is opposite to the centrifugal direction φ1. When the rear door 320 is at the open position P12, the distal end 322 of the rear door is separated from the rear end 317 in one circumferential direction θ1 which is one circumferential direction θ. The other side θ2 of the circumferential direction is opposite to the one side θ1 of the circumferential direction.

The cooling device 200 (see FIG. 1) is installed outside the space A01, for example. The cooling device 200 may be installed any of indoors and outdoors. The cooling device 200 is, for example, a chiller or a cooling tower. The cooling device 200 includes primary refrigerant ports 210 and 220, a cooling unit 240, and a pump 250.

The primary refrigerant is, for example, a coolant. Examples of the coolant include antifreeze liquid and pure water. A typical example of antifreeze liquid is an ethylene glycol aqueous solution or a propylene glycol aqueous solution. The primary refrigerant may be a gas refrigerant. The primary refrigerant is an example of the "second refrigerant" of the present disclosure.

In the present example embodiment, the ports 210 and 220 are an inlet and an outlet of the primary refrigerant. The primary refrigerant flowing into the port 210 flows into the cooling unit 240 through the flow path. The cooling unit 240 cools the primary refrigerant flowing into the cooling unit 240. The cooling system in the cooling unit 240 may be any of an air cooling system and a water cooling system. The primary refrigerant flowing out of the cooling unit 240 flows into the pump 250 through the flow path. The pump 250 pressure-feeds, toward the port 220, the primary refrigerant flowing into the pump 250. In FIG. 1, the pump 250 is located between the cooling unit 240 and the port 220 in the flow path of the primary refrigerant. However, the pump 250 may be located between the port 210 and the cooling unit 240 in the flow path of the primary refrigerant.

The system 100 cools the heat source 400 in the rack 300. The system 100 includes a radiator 11, a fan 12, a CDU 13, a distribution manifold 14, a collection manifold 15, and a cold plate 16. The radiator 11 and the fan 12 are installed in the rear door 320. The CDU 13, the distribution manifold 14, and the collection manifold 15 are preferably provided in the chassis 310 of the rack 300. However, the present disclosure is not limited thereto, and the CDU 13, the distribution manifold 14, and the collection manifold 15 may be provided outside the chassis 310. The cold plate 16 is provided to be in thermal contact with the first heat source 401.

Figure 3:
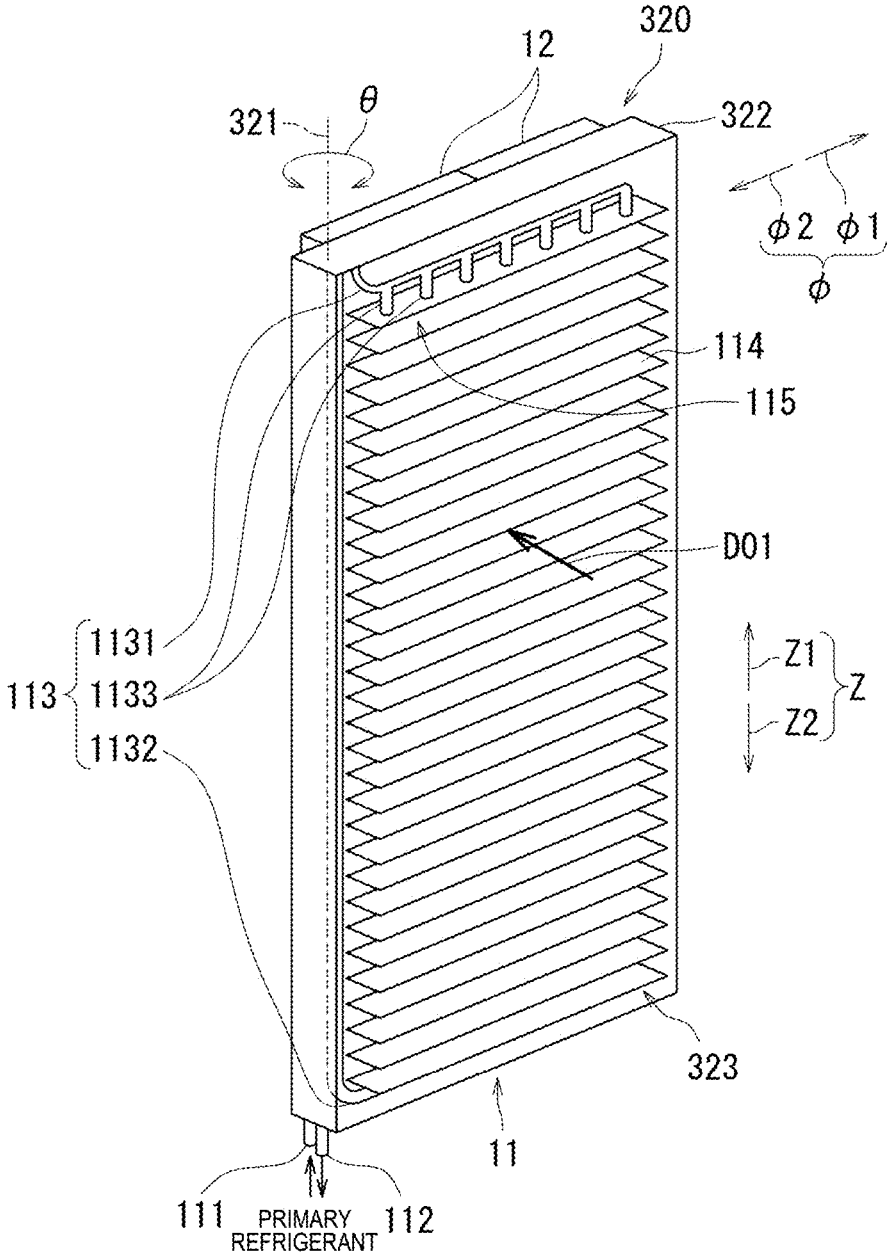

FIG. 3 is a detailed diagram illustrating configuration of the rear door 320 and the radiator 11 illustrated in FIG. 1. As illustrated in FIG. 3, the radiator 11 is built in the rear door 320. Specifically, the rear door 320 is formed with a hole 323 penetrating the rear door 320 in a direction (hereinafter, referred to as a "intersecting direction") D01 intersecting the radial direction φ.

The radiator 11 is in contact with air (high temperature) in the rack 300. In the radiator 11, a primary refrigerant (low temperature) different from the secondary refrigerant flows therein. Thus, the radiator 11 cools the air in the rack 300. Here, the air in the rack 300 also includes the meaning of the air discharged from the rack 300 by the operation of the fan 12 (details will be described later).

Specifically, the radiator 11 includes primary refrigerant ports 111 and 112, a flow path 113, and a plurality of fins 114.

In the present example embodiment, the ports 111 and 112 are an inlet and an outlet of the primary refrigerant. The port 111 is connected to the port 220 (see FIG. 1) of the cooling device 200 through a flow path. The port 112 is connected to a port 131 through a flow path. The flow path 113 is a pipe provided in the hole 323. The flow path 113 is made of a material having a relatively high thermal conductivity (for example, copper or aluminum). The flow path 113 connects the ports 111 and 112 to each other such that the primary refrigerant can flow therebetween. Specifically, the flow path 113 includes common flow paths 1131 and 1132 and a plurality of branch flow paths 1133.

The common flow path 1131 extends, for example, along an end of the rear door 320 on the one side Z1 of the first direction. The common flow path 1132 extends, for example, along the other end of the rear door 320 on the other side Z2 of the first direction. Each of the plurality of branch flow paths 1133 extends along the first direction Z between the common flow paths 1131 and 1132. Among the plurality of branch flow paths 1133, two branch flow paths 1133 adjacent to each other in the radial direction φ are arranged at intervals in the radial direction φ.

Each of the plurality of fins 114 is formed, for example, in a wave shape with a thin metal plate or the like. The plurality of fins 114 are arranged at intervals in the first direction Z and are in physical contact with the plurality of branch flow paths 1133. Each fin 114 and the plurality of branch flow paths 1133 define a ventilation path 115 penetrating in an intersecting direction D01. Air flows through the plurality of ventilation paths 115.

In FIG. 3, only two branch flow paths are denoted by reference numeral "1133". Only one fin is denoted by reference numeral "114". Only one ventilation path is denoted by reference numeral "115".

In the common flow path 1131, the primary refrigerant flowing into the port 111 flows. Thereafter, the primary refrigerant flows through each of the branch flow paths 1133 and then flows into the common flow path 1132. Thereafter, the primary refrigerant flows through the common flow path 1132 and then flows out of the port 112.

The fan 12 is, for example, an axial fan, and is attached to the rear door 320. The fan 12 rotates an impeller included in the fan 12 under the control of a controller 139. As a result, the fan 12 generates an airflow passing through the ventilation path 115 (that is, the radiator 11). That is, the fan 12 discharges the air in the chassis 310 to the outside of the chassis 310 through the ventilation path 115. As a result, the heat confined in the chassis 310 by the first heat source 401 and the second heat source 402 moves to the outside of the chassis 310. Accordingly, the first heat source 401 and the second heat source 402 are air-cooled. The performance of the radiator 11 to cool the air in the rack 300 by the fan 12 is improved as compared with the case where the fan 12 is not provided. Specifically, the airflow passes through the plurality of branch flow path 1133 of the radiator 11. That is, the air (high temperature) in the rack 300 comes into contact with the radiator 11 by the operation of the fan 12.

The fan 12 may be attached to a portion other than the rear door 320 in the chassis 310. The fan 12 may be attached in the chassis 310. The first heat source 401 and the second heat source 402 are air-cooled well by attaching the fan 12 to a plurality of places in the chassis 310.

FIG. 4 is a diagram illustrating a detailed configuration of the system 100 illustrated in FIG. 1. In FIG. 4, the cooling device 200 is illustrated in addition to the system 100. In FIG. 4, only one cold plate 16 is illustrated and no heat source 400 is illustrated for ease of understanding.

As illustrated in FIG. 4, the CDU 13 cools the secondary refrigerant and circulates the cooled secondary refrigerant within the system 100. The CDU 13 includes a chassis 130, four ports 131 to 134, a heat exchanger 137, a pump 138, and a controller 139 as components.

The chassis 130 accommodates the heat exchanger 137, the pump 138, and the controller 139. Since the heat exchanger 137, the pump 138, and the controller 139 are collectively accommodated in the chassis 130, it is easy to install the system 100.

In the present example embodiment, the ports 131 and 132 are an inlet and an outlet of the primary refrigerant, and is provided in the chassis 130. The port 131 is connected to the port 112 of the radiator 11 through the flow path. The port 132 is connected to the port 210 of the cooling device 200 through a flow path.

The primary refrigerant flowing out of the port 112 flows into the port 131. The primary refrigerant flows into a flow path 1375 of the heat exchanger 137 from a port 1371 of the heat exchanger 137 through the flow path. Next, the primary refrigerant flows through the flow path 1375 and flows out of a port 1372 of the heat exchanger 137. The primary refrigerant further flows out of the port 132 through the flow path.

In the present example embodiment, ports 133 and 134 are an inlet and an outlet of the secondary refrigerant, and are provided in the chassis 130. The secondary refrigerant may be the same type of refrigerant as the primary refrigerant. The secondary refrigerant may be different from the primary refrigerant. The secondary refrigerant is an example of the "first refrigerant" of the present disclosure.

The port 133 is connected to an outlet of the collection manifold 15. The port 134 is connected to the cold plate 16 through the distribution manifold 14.

The secondary refrigerant having a relatively high temperature flows into the port 133 from the outlet of the collection manifold 15. The secondary refrigerant flows into a port 1373 of the heat exchanger 137 from the port 133 through the flow path. The secondary refrigerant flows through a flow path 1376 from the port 1373, and then flows out of a port 1374 of the heat exchanger 137.

The heat exchanger 137 exchanges heat between the secondary refrigerant flowing out of the cold plate 16 and the primary refrigerant. Therefore, the performance of cooling the first heat source 401 is improved.

Specifically, the heat exchanger 137 exchanges heat between the secondary refrigerant flowing out of the cold plate 16 and the primary refrigerant flowing out of the radiator 11. In other words, the primary refrigerant having a relatively low temperature flows in the radiator 11. Therefore, the air in the rack 300 is cooled to a relatively low temperature by the primary refrigerant and discharged.

Specifically, the heat exchanger 137 is, for example, a plate-type heat exchanger, and is provided in the chassis 130. The heat exchanger 137 includes a plurality of heat transfer plates 1377 in addition to the ports 1371 to 1374 and the flow paths 1375 and 1376.

In the present example embodiment, the ports 1371 and 1372 are an inlet and an outlet of the primary refrigerant.

The flow path 1375 is a pipe provided inside the heat exchanger 137. The flow path 1375 connects the ports 1371 and 1372 to each other so that the primary refrigerant having a medium temperature can flow therebetween. Therefore, in the present example embodiment, the primary refrigerant (medium temperature) flowing out of the radiator 11 flows through the flow path 1375.

In the present example embodiment, the ports 1373 and 1374 are an inlet and an outlet of the secondary refrigerant. The flow path 1376 is a pipe provided inside the heat exchanger 137. The flow path 1376 connects the ports 1373 and 1374 to each other so that a primary refrigerant (high temperature) can flow therebetween. Accordingly, in the present example embodiment, the secondary refrigerant (high temperature) flowing out of each cold plate 16 flows through the flow path 1376.

The plurality of heat transfer plates 1377 are disposed at intervals in the heat exchanger 137. The flow paths 1375 and 1376 are inserted into through holes formed in the plurality of heat transfer plates 1377 in a state of being physically isolated from each other in the heat exchanger 137. Therefore, heat exchange is performed through the plurality of heat transfer plates 1377 between the primary refrigerant (medium temperature) flowing through the flow path 1375 and the secondary refrigerant (high temperature) flowing through the flow path 1376. As a result, the secondary refrigerant is cooled to a lower temperature when flowing out of the port 1374 than when flowing into the port 1373. On the other hand, the primary refrigerant is heated to a higher temperature when flowing out of the port 1372 than when flowing into the port 1371.

The secondary refrigerant (low temperature) flowing out of the port 1374 flows into the pump 138. The pump 138 pressure-feeds the secondary refrigerant flowing into the pump 138 toward the port 134 under the control of the controller 139. The secondary refrigerant thus circulates in the system 100. In FIG. 1, the pump 138 is located between the heat exchanger 137 and the port 134 in the flow path of the secondary refrigerant. However, the pump 138 may be located between the port 133 and the heat exchanger 137 in the flow path of the secondary refrigerant.

The distribution manifold 14 has a common flow path 141 and a plurality of individual flow paths 142 (see FIG. 1). In FIG. 1, for easy understanding of illustration, only two individual flow paths are denoted by reference numeral "142". The secondary refrigerant can flow through each of the common flow path 141 and the plurality of individual flow paths 142. One end of each of the individual flow paths 142 is connected to the common flow path 141 so that the secondary refrigerant can flow therethrough. The other end of one of the plurality of individual flow paths 142 is used as an inlet of the secondary refrigerant in the distribution manifold 14, and is connected to the port 134 (see FIG. 4). The other ends of the remaining individual flow paths 142 are used as outlets of the secondary refrigerant in the distribution manifold 14, and are individually connected to the cold plate 16 (see FIG. 4). Therefore, the secondary refrigerant (low temperature) flowing into the inlet circulates from one of the whole individual flow paths 142 to the common flow path 141, is divided by the remaining individual flow path 142, and then flows out of each outlet.

The collection manifold 15 has a plurality of the individual flow paths 151 and a common flow path 152. The secondary refrigerant can flow through each of the plurality of individual flow paths 151 and the common flow path 152. One end of each of the individual flow paths 151 is connected to the common flow path 152 so that the secondary refrigerant can flow therethrough (see FIG. 4). The other end of one of the individual flow paths 151 is used as the outlet of the secondary refrigerant in the collection manifold 15, and is connected to the port 133. The other ends of the remaining individual flow paths 151 are individually connected to the cold plate 16 as an inlet of the secondary refrigerant in the collection manifold 15. Therefore, the secondary refrigerant flowing from the cold plate 16 into each inlet in the individual flow path 151 joins in the common flow path 152, and flows out of the outlet of the individual flow path 151 toward the port 133.

Each cold plate 16 is in thermal contact with at least one first heat source 401. Each cold plate 16 may be in thermal contact with the plurality of first heat sources 401. Each cold plate 16 may be in thermal contact with the first heat source 401 and the second heat source 402. The secondary refrigerant flows through each cold plate 16. In detail, each cold plate 16 is arranged in direct thermal contact with the first heat source 401 (see FIG. 1). Each cold plate 16 may be arranged in thermal contact with the first heat source 401 via a thermally conductive sheet (not illustrated). That is, the term "thermal contact" includes the meaning of "direct thermal contact" and the meaning of "indirect thermal contact".

Each cold plate 16 has an inlet and an outlet of the secondary refrigerant. A refrigerant flow path (not illustrated) extending from the inlet to the outlet is provided inside the cold plate 16. The secondary refrigerant (low temperature) flows into the inlet from the individual flow path 142 connected to the outlet. The secondary refrigerant flows through the flow path in the cold plate 16 toward the outlet. Accordingly, the heat generated by the first heat source 401 moves to the secondary refrigerant flowing in the cold plate 16 in thermal contact with the first heat source 401. As a result, the first heat source 401 is cooled, and the temperature of the secondary refrigerant becomes high. The secondary refrigerant (high temperature) flows out of the outlet to the individual flow path 151 of the collection manifold 15.

In the example embodiment, the first heat source 401 having a larger calorific value than the second heat source 402 is cooled by the cold plate 16. Heat in the rack 300 is discharged to the outside of the rack 300 by the airflow generated by the fan 12. Therefore, both the first heat source 401 and the second heat source 402 are air-cooled. That is, the first heat source 401 that is difficult to be sufficiently cooled only by the fan 12 is cooled by the cold plate 16. Accordingly, example embodiments may provide the system 100 with improved cooling performance.

The controller 139 has a microcomputer, a memory, and the like. In the controller 139, the microcomputer operates according to a program stored in the memory. As a result, the controller 139 controls each operation of the pump 138 and the fan 12. As a result, the configuration of the system 100 is simplified as compared with a case where the controller that controls the operation of the pump 138 and the controller that controls the operation of the fan 12 are individually provided.

The system 100 and the cooling device 200 may be provided with temperature sensors (not illustrated) for detecting temperatures of the primary refrigerant and the secondary refrigerant. In addition, another temperature sensor (not illustrated) for detecting the temperature in the rack 300 may be provided. The controller 139 controls the operation of at least one of the pump 138 and the fan 12 based on each temperature detected by the temperature sensor. This facilitates adjustment of the cooling performance by the system 100.

FIG. 5 is a diagram illustrating a detailed configuration of a system 100 according to a modification (hereinafter, described as a "first modification") of the first example embodiment. In FIG. 5, only one cold plate 16 is illustrated and no heat source 400 is illustrated for ease of understanding.

As illustrated in FIG. 5, the CDU 13 of the first modification is similar to the CDU 13 of the first example embodiment in terms of components. In FIG. 5, a cooling device 200 is illustrated in addition to the system 100.

In the CDU 13, the ports 131 and 132 are an outlet and an inlet of the primary refrigerant in the present modification. The port 132 is connected to the port 220 of the cooling device 200 through a flow path. The port 131 is connected to the port 111 of the radiator 11 through the flow path.

The primary refrigerant flowing out of the port 132 flows into the port 220. The primary refrigerant flows into the flow path 1375 of the heat exchanger 137 from the port 1372 of the heat exchanger 137 through the flow path. Next, the primary refrigerant flows through the flow path 1375 and flows out of a port 1371 of the heat exchanger 137. The primary refrigerant further flows out of the port 131 through the flow path.

The heat exchanger 137 exchanges heat between the secondary refrigerant flowing out of the cold plate 16 and the primary refrigerant. Specifically, the heat exchanger 137 exchanges heat between the secondary refrigerant flowing out of the cold plate 16 and the primary refrigerant flowing out of the cooling device 200. In other words, the primary refrigerant having a relatively low temperature flows in the flow path 1375 of the heat exchanger 137. Therefore, the secondary refrigerant flowing out of the cold plate 16 and flowing through the flow path 1376 is cooled to a relatively low temperature by the primary refrigerant and discharged. As a result, the performance of the system 100 to cool the first heat source 401 in thermal contact with the cold plate 16 is improved.

In the present example embodiment, the ports 111 and 112 are an inlet and an outlet of the primary refrigerant. The port 111 is connected to a port 131 of the CDU 13 through a flow path. The port 112 is connected to the port 210 of the cooling device 200 through a flow path. In the common flow path 1131 of the radiator 11, the primary refrigerant flowing into the port 111 flows. Thereafter, the primary refrigerant flows through each of the branch flow paths 1133 and then flows into the common flow path 1132. Thereafter, the primary refrigerant flows through the common flow path 1132 and then flows out of the port 112.

The fan 12 generates an airflow passing through the ventilation paths 115 (that is, the radiator 11) in the plurality of ventilation paths 115. Here, the primary refrigerant flowing through the radiator 11 is cooled or heated by the air in the rack 300. When the primary refrigerant is heated, the cooled air is discharged to the outside of the rack 300. Therefore, the temperature rise of the space A01 can be suppressed. On the other hand, when the primary refrigerant is cooled, the primary refrigerant is more efficiently cooled in the cooling device 200.

The fan 12 discharges the air in the rack 300 to the outside of the rack 300 together with the heat in the rack 300. As a result, both the first heat source 401 and the second heat source 402 are air-cooled. The first heat source 401 that is difficult to sufficiently cool only by the fan 12 is cooled by the cold plate 16. Therefore, by combining the fan 12 and the cold plate 16, it is possible to provide the system 100 with improved cooling performance.

FIG. 6 is a diagram illustrating a detailed configuration of a system 100 according to a second example embodiment. In FIG. 6, only one cold plate 16 is illustrated and no heat source 400 is illustrated for ease of understanding.

As illustrated in FIG. 6, the system 100 of the second example embodiment is different from the system 100 of the first example embodiment in that it does not include the cooling device 200 and that it does not include the heat exchanger 137 in the CDU 13.

The ports 133 and 134 are an inlet and an outlet of the secondary refrigerant in the present example embodiment as in the first example embodiment. The port 133 is connected to the port 112 of the radiator 11 through the flow path. The port 134 is connected to the inlet of the distribution manifold 14.

The collection manifold 15 has a plurality of the individual flow paths 151 and a common flow path 152. The secondary refrigerant can flow through each of the plurality of individual flow paths 151 and the common flow path 152. One end of each of the individual flow paths 151 is connected to the common flow path 152 so that the secondary refrigerant can flow therethrough (see FIG. 4). The other end of one of the individual flow paths 151 is used as the outlet of the secondary refrigerant in the collection manifold 15, and is connected to the port 111 of the radiator 11. The other ends of the remaining individual flow paths 151 are individually connected to the cold plate 16 as an inlet of the secondary refrigerant in the collection manifold 15. Therefore, the secondary refrigerant flowing from the cold plate 16 into each inlet in the individual flow path 151 joins in the common flow path 152, and flows out of the outlet of the individual flow path 151 toward the port 111.

Under the control of the controller 139, the pump 138 pressure-feeds the secondary refrigerant (low temperature) cooled by the radiator 11 toward the port 134 (that is, the cold plate 16). Accordingly, a secondary refrigerant having a relatively low temperature circulates in the cold plate 16 and hence, the performance of the system 100 to cool the first heat source 401 (see FIG. 1) can be enhanced.

FIG. 7 is a diagram illustrating a detailed configuration of a system 100 according to a modification (hereinafter, described as a "second modification") of the second example embodiment. In FIG. 7, a cooling device 200 is illustrated in addition to the system 100. In FIG. 7, only one cold plate 16 is illustrated and no heat source 400 is illustrated for ease of understanding.

As illustrated in FIG. 7, the CDU 13 of the second modification is similar to the CDU 13 of the first example embodiment in terms of components.

In the present example embodiment, the ports 131 and 132 are an inlet and an outlet of the primary refrigerant. The ports 131 and 132 are respectively connected to the ports 220 and 210 of the cooling device 200 through flow paths.

The primary refrigerant flowing out of the port 220 flows into the port 131. The primary refrigerant flows into a flow path 1375 of the heat exchanger 137 from a port 1371 of the heat exchanger 137 through the flow path. Next, the primary refrigerant flows through the flow path 1375 and flows out of a port 1372 of the heat exchanger 137. The primary refrigerant further flows out of the port 132 through the flow path.

The ports 133 and 134 are an inlet and an outlet of the secondary refrigerant in the present example embodiment as in the second modification. The port 133 is connected to the port 112 of the radiator 11 through the flow path. The port 134 is connected to the inlet of the distribution manifold 14. Therefore, the secondary refrigerant flows in the heat exchanger 137 as in the first example embodiment.

The collection manifold 15 has a plurality of the individual flow paths 151 and a common flow path 152. The secondary refrigerant can flow through each of the plurality of individual flow paths 151 and the common flow path 152. One end of each of the individual flow paths 151 is connected to the common flow path 152 so that the secondary refrigerant can flow therethrough (see FIG. 4). The other end of one of the individual flow paths 151 is used as the outlet of the secondary refrigerant in the collection manifold 15, and is connected to the port 111 of the radiator 11. The other ends of the remaining individual flow paths 151 are individually connected to the cold plate 16 as an inlet of the secondary refrigerant in the collection manifold 15. Therefore, the secondary refrigerant flowing from the cold plate 16 into each inlet in the individual flow path 151 joins in the common flow path 152, and flows out of the outlet of the individual flow path 151 toward the port 111.

The heat exchanger 137 is located downstream of the radiator 11 and upstream of the cold plate 16 in the flow path of the secondary refrigerant. The heat exchanger 137 exchanges heat between the secondary refrigerant (high temperature) flowing out of the radiator 11 and the primary refrigerant different from the secondary refrigerant. In the present example embodiment, the primary refrigerant flows out of the cooling device 200. Therefore, in the heat exchanger 137, the secondary refrigerant from the radiator 11 is cooled to a relatively low temperature by the primary refrigerant. The secondary refrigerant having a relatively low temperature circulates in the cold plate 16 and hence, the performance of the system 100 to cool the first heat source 401 can be enhanced.

Under the control of the controller 139, the pump 138 pressure-feeds the secondary refrigerant (low temperature) flowing out of the heat exchanger 137 toward the port 134 (that is, the cold plate 16). Accordingly, the secondary refrigerant having a relatively low temperature circulates in the cold plate 16 and hence, the performance of the system 100 to cool the first heat source 401 can be enhanced.

FIG. 8 is a diagram illustrating a detailed configuration of a system 100 according to another modification (hereinafter, described as a "third modification") of the second example embodiment. In FIG. 8, a cooling device 200 is illustrated in addition to the system 100. In FIG. 8, only one cold plate 16 is illustrated and no heat source 400 is illustrated for ease of understanding.

As illustrated in FIG. 8, the CDU 13 of the second modification is similar to the CDU 13 of the first example embodiment in terms of components.

In the present modification, the ports 131 and 132 are an inlet and an outlet of the primary refrigerant. The ports 131 and 132 are respectively connected to the ports 220 and 210 of the cooling device 200 through flow paths.

The primary refrigerant flowing out of the port 220 flows into the port 131. The primary refrigerant flows into a flow path 1375 of the heat exchanger 137 from a port 1371 of the heat exchanger 137 through the flow path. Next, the primary refrigerant flows through the flow path 1375 and flows out of a port 1372 of the heat exchanger 137. The primary refrigerant further flows out of the port 132 through the flow path.

The ports 133 and 134 are an inlet and an outlet of the secondary refrigerant as in the first example embodiment. The port 133 is connected to the inlet of the distribution manifold 14. The port 134 is connected to the port 112 of the radiator 11 through the flow path. Therefore, the secondary refrigerant flows in the heat exchanger 137 as in the first example embodiment.

In the distribution manifold 14, the secondary refrigerant can flow through each of the common flow path 141 and the plurality of individual flow paths 142. In FIG. 7, only two individual flow paths 142 are illustrated for ease of viewing. One end of each of the individual flow paths 142 is connected to the common flow path 141 so that the secondary refrigerant can flow therethrough. The other end of one of the plurality of individual flow paths 142 is used as an inlet of the secondary refrigerant in the distribution manifold 14, and is connected to the port 112 of the radiator 11. The other ends of the remaining individual flow paths 142 are used as outlets of the secondary refrigerant in the distribution manifold 14, and are individually connected to the cold plate 16. Therefore, the secondary refrigerant (low temperature) flowing into the inlet circulates from one of the whole individual flow paths 142 to the common flow path 141, is divided by the remaining individual flow path 142, and then flows out of each outlet.

In the collection manifold 15, the secondary refrigerant can flow through each of the plurality of individual flow paths 151 and the common flow path 152. In FIG. 7, only two individual flow paths 151 are illustrated for ease of viewing. One end of each of the individual flow paths 151 is connected to the common flow path 152 so that the secondary refrigerant can flow therethrough. The other end of one of the individual flow paths 151 is used as the outlet of the secondary refrigerant in the collection manifold 15, and is connected to the port 133 of the CDU 13. The other ends of the remaining individual flow paths 151 are individually connected to the cold plate 16 as an inlet of the secondary refrigerant in the collection manifold 15. Therefore, the secondary refrigerant flowing from the cold plate 16 into each inlet in the individual flow path 151 joins in the common flow path 152, and flows out of the outlet of the individual flow path 151 toward the port 133.

The heat exchanger 137 is located downstream of the cold plate 16 and upstream of the radiator 11 in the flow path of the secondary refrigerant. The heat exchanger 137 exchanges heat between the secondary refrigerant (high temperature) flowing out of the cold plate 16 and the primary refrigerant different from the secondary refrigerant. In the present modification, the primary refrigerant flows out of the cooling device 200. Therefore, in the heat exchanger 137, the secondary refrigerant from the cold plate 16 is cooled to a relatively low temperature by the primary refrigerant. As a result, since the primary refrigerant (low temperature) flows through the radiator 11, discharge of high-temperature air to the outside of the rack 300 is suppressed.

FIG. 9 is a diagram illustrating a first configuration example of a first flow path 17 that connects the radiator 11 and the heat exchanger 137 illustrated in FIG. 4.

As illustrated in FIG. 9, the system 100 further includes the first flow path 17. The first flow path 17 is connected to the radiator 11. The primary refrigerant flows through the first flow path 17. The first flow path 17 has an upstream portion 171 and a downstream portion 172. The upstream portion 171 and the downstream portion 172 are examples of "portions" of the present disclosure. The upstream portion 171 and the downstream portion 172 are made of hard resin or metal. One ends of the upstream portion 171 and the downstream portion 172 are connected to the common flow path 1131 and the common flow path 1132 of the radiator 11 so that the radiator 11 is rotatable about the rotation axis 321. The other end of the upstream portion 171 is connected to the port 220 of the cooling device 200. The other end of the downstream portion 172 is connected to the port 131 of the CDU 13. The upstream portion 171 and the downstream portion 172 are realized, for example, by swivel joints. The upstream portion 171 and the downstream portion 172 allow the primary refrigerant to circulate between the cooling device 200, the radiator 11, and the heat exchanger 137.

FIG. 10 is a diagram illustrating a second configuration example of the first flow path 17 that connects the radiator 11 and the heat exchanger 137 illustrated in FIG. 4.

As illustrated in FIG. 10, the system 100 further includes the first flow path 17. The first flow path 17 is connected to the radiator 11. The primary refrigerant flows through the first flow path 17. The first flow path 17 has an upstream portion 171 and a downstream portion 172. The upstream portion 171 and the downstream portion 172 are other examples of "portions" of the present disclosure. The upstream portion 171 and the downstream portion 172 are portions made of resin or metal having flexibility and bent in response to opening and closing of the rear door 320. One ends of the upstream portion 171 and the downstream portion 172 are connected to the common flow path 1131 and the common flow path 1132 of the radiator 11. The other end of the upstream portion 171 is connected to the port 220 of the cooling device 200. The other end of the downstream portion 172 is connected to the port 131 of the CDU 13. The upstream portion 171 and the downstream portion 172 allow the primary refrigerant to circulate between the cooling device 200, the radiator 11, and the heat exchanger 137.

In the first configuration example and the second configuration example, assuming a case where the primary refrigerant leaks from the upstream portion 171 and the downstream portion 172 and a case where dew condensation occurs in the upstream portion 171 and the downstream portion 172, for example, a tray-shaped receiving member is preferably disposed at the position of the upstream portion 171 and the downstream portion 172 on the other side Z2 of the first direction.

The drawings schematically show each component mainly in order to facilitate understanding of the present disclosure, and the thickness, length, number, interval, and the like of each component that is shown may be different from the actual ones for convenience of the drawings. The configuration of each component shown in the above example embodiment is an example and is not particularly limited, and it goes without saying that various modifications can be made without substantially departing from the effects of the present disclosure.

In each example embodiment and each modification, the radiator 11 is provided on the rear door 320. However, the present disclosure is not limited thereto, and the radiator 11 may be provided in the chassis 310.

The present technology can also adopt the following configurations.

(1) A system to cool a heat source in a rack, the system including a cold plate that is in thermal contact with the heat source and through which a first refrigerant flows, a radiator that is in contact with air in the rack and through which a second refrigerant different from the first refrigerant flows, and a heat exchanger to exchange heat between the first refrigerant flowing out of the cold plate and the second refrigerant.

(2) The system according to (1), in which the heat exchanger is operable to exchange heat between the first refrigerant flowing out of the cold plate and the second refrigerant flowing out of the radiator.

(3) The system according to (1), in which the heat exchanger is operable to exchange heat between the first refrigerant flowing out of the cold plate and the second refrigerant, and the second refrigerant flowing out of the heat exchanger flows inside the radiator.

(4) The system according to any one of (1) to (3), in which the rack includes a chassis including an opening, and a door provided in the radiator to open and close the opening by rotating around a rotation axis, the system further includes a first flow path connected to the radiator and through which the second refrigerant flows, the first flow path includes a portion to which the radiator is connected to be rotatable about the rotation axis.

(5) The system according to any one of (1) to (3), in which the rack includes a chassis including an opening, and a door provided in the radiator to open and close the opening by rotating around a rotation axis, the system further includes a first flow path connected to the radiator and through which the second refrigerant flows, and the first flow path includes a portion that bends in response to opening or closing of the door.

(6) A system to cool a heat source in a rack, the system including a cold plate that is in thermal contact with the heat source and through which a first refrigerant flows, and a radiator that is in contact with air in the rack and through which the first refrigerant flowing out of the cold plate flows.

(7) The system according to (6), further including a heat exchanger that is located downstream of the radiator and upstream of the cold plate in a flow path of the first refrigerant and exchanges heat between the first refrigerant flowing out of the radiator and a second refrigerant different from the first refrigerant.

(8) The system according to (7), further including a pump to pressure-feed the first refrigerant flowing out of the heat exchanger to the cold plate.

(9) The system according to (6), further including a heat exchanger that is located downstream of the cold plate and upstream of the radiator in a flow path of the first refrigerant and exchanges heat between the first refrigerant flowing out of the cold plate and a second refrigerant different from the first refrigerant.

(10) The system according to any one of (1) to (9), further including a pump to pressure-feed the first refrigerant, and a chassis that accommodates the pump and the heat exchanger.

(11) The system according to any one of (1) to (10), further including a fan to generate an airflow passing through the radiator.

(12) The system of any one of (1) to (11), further including a pump to pressure-feed the first refrigerant, a fan to generate an airflow passing through the radiator, and a controller configured or programmed to control operation of the pump and the fan.

The systems according to example embodiments of the present disclosure are capable of cooling a heat source and have industrial applicability.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A system to cool a heat source in a rack, the system comprising:

a first flow path including a cold plate that is in thermal contact with the heat source and through which a first refrigerant flows;

a second flow path including a radiator that is in contact with air in the rack and through which a second refrigerant different from the first refrigerant flows; and a heat exchanger that is configured to exchange heat between the first refrigerant flowing out of the cold plate and the second refrigerant; wherein the first flow path and the second flow path are closed loops such that the first refrigerant and the second refrigerant remain physically separated;

the heat exchanger includes (i) an inlet port and an outlet port which are connected to the second flow path including the radiator and (ii) an additional inlet port and an additional outlet port which are connected to the first flow path including the cold plate; and in the first flow path, the outlet port is directly connected to an inlet of the radiator and an outlet of the radiator is directly connected to an inlet of a cooler.

2. The system according to claim 1, wherein the heat exchanger is operable to exchange heat between the first refrigerant flowing out of the cold plate and the second refrigerant flowing out of the radiator.

3. The system according to claim 1, wherein the heat exchanger is operable to exchange heat between the first refrigerant flowing out of the cold plate and the second refrigerant; and the second refrigerant flowing out of the heat exchanger flows inside the radiator.

4. The system according to claim 1, wherein the rack includes:

a chassis including an opening; and a door provided in the radiator to open and close the opening by rotating around a rotation axis;

the first flow path includes a portion to which the radiator is connected to be rotatable about the rotation axis.

5. The system according to claim 1, wherein the rack includes:

a chassis including an opening; and a door provided in the radiator to open and close the opening by rotating around a rotation axis; and the first flow path includes a portion that bends in response to opening or closing of the door.

6. The system according to claim 1, further comprising:

a pump that is configured to pressure-feed the first refrigerant; and a chassis that accommodates the pump and the heat exchanger.

7. The system according to claim 1, further comprising a fan that is configured to generate an airflow passing through the radiator.

8. The system according to claim 1, further comprising:

a pump that is configured to pressure-feed the first refrigerant;

a fan that is configured to generate an airflow passing through the radiator; and a controller configured or programmed to control operation of the pump and the fan.

9. The system according to claim 1, wherein the first refrigerant and the second refrigerant have different compositions.

10. A system to cool a heat source in a rack, the system comprising:

a cold plate that is in thermal contact with the heat source and through which a first refrigerant flows; and a radiator that is in contact with air in the rack and through which a second refrigerant flows; wherein the radiator is connected to a second flow path containing the second refrigerant and the cold plate is connected to a first flow path containing the first refrigerant;

the first flow path and the second flow path are closed loops such that the first refrigerant and the second refrigerant remain physically separated; and in the second flow path, an outlet of the radiator is directly connected to an inlet of a cooler.

11. The system according to claim 10, further comprising a heat exchanger that is located downstream of the radiator and upstream of the cold plate to exchange heat between the first refrigerant flowing out of the radiator and the second refrigerant.

12. The system according to claim 11, further comprising a pump to pressure-feed the first refrigerant flowing out of the heat exchanger to the cold plate.

13. The system according to claim 10, further comprising a heat exchanger that is located downstream of the cold plate and upstream of the radiator to exchange heat between the first refrigerant flowing out of the cold plate and the second refrigerant.

14. The system according to claim 10, wherein the first refrigerant and the second refrigerant have different compositions.

* * * * *